US006257196B1

(12) United States Patent
Alvarado

(10) Patent No.: US 6,257,196 B1
(45) Date of Patent: Jul. 10, 2001

(54) ROTARY DISC ENGINE

(76) Inventor: Alfredo Alvarado, 4310 Bayview Dr., Ft. Lauderdale, FL (US) 33308

( * ) Notice: Subject to any disclaimer, the term of this patent is extended or adjusted under 35 U.S.C. 154(b) by 0 days.

(21) Appl. No.: 09/391,877

(22) Filed: Sep. 7, 1999

(51) Int. Cl.[7] ..... F02B 53/00
(52) U.S. Cl. ..... 123/245; 418/35; 418/36
(58) Field of Search ..... 123/245; 418/36, 418/35

(56) References Cited

U.S. PATENT DOCUMENTS

| | | | | |
|---|---|---|---|---|
| 3,256,866 | * | 6/1966 | Bauer | 418/36 |
| 3,282,258 | | 11/1966 | Sinnott | 418/35 |
| 3,340,815 | * | 9/1967 | Sinnot | 418/35 |
| 3,592,571 | * | 7/1971 | Drury | 418/36 |
| 3,595,014 | | 7/1971 | McMaster | 60/19 |
| 3,744,938 | * | 7/1973 | Matvey | 418/36 |
| 3,989,012 | * | 11/1976 | Doundoulakis | 418/36 |
| 4,127,367 | | 11/1978 | Smith | 418/36 |
| 4,319,551 | * | 3/1982 | Rubinshtein | 123/245 |
| 4,666,379 | | 5/1987 | Smith | 418/35 |
| 4,744,736 | | 5/1988 | Stauffer | 418/35 |
| 5,069,604 | * | 12/1991 | Al-Sabih | 418/36 |
| 5,330,333 | * | 7/1994 | Holmes | 418/35 |
| 5,400,754 | | 3/1995 | Blanco Palacios | 123/245 |
| 5,484,272 | | 1/1996 | Horn | 418/35 |
| 5,622,149 | * | 4/1997 | Wittry | 123/245 |
| 6,036,461 | * | 3/2000 | Bahniuk | 413/35 |

FOREIGN PATENT DOCUMENTS

WO86/06786 * 11/1986 (WO) .

* cited by examiner

*Primary Examiner*—Thomas Denion
*Assistant Examiner*—Thai-Ba Trieu
(74) *Attorney, Agent, or Firm*—Oltman, Flynn & Kubler

(57) ABSTRACT

A rotary internal combustion engine comprising a generally cylindrical shaped rotor housing, a pair of cylindrical shaped rotary discs having inner and outer concentric members and a plurality of spaced apart vanes connecting the inner and outer concentric members and extending axially outward therefrom, a pair of substantially flat stators mounted over the open ends of the rotor housing and an injection system. The rotary discs are structured for mating engagement with one another by inserting the vanes of each rotary disc into the chambers of the other rotary disc formed by the vanes and the inner and outer members, thereby forming an interlocked rotary disc assembly structured to rotate within the rotary housing. A plurality of spark plugs protrude through spaced apart mounting holes in one of the stators and into the combustion chambers. A plurality of spaced apart exhaust ports extend through the other stator. A hollow tubular member extends out from a centrally disposed bore in each rotary disc and a free wheel embedded therein and through a centrally disposed free wheel in the corresponding stator. The free wheels are connected to a central shaft which extends through the tubular member to produce a continuous rotation in a single direction. A gear wheel, structured to mesh with the gears of a starting motor, is mounted on the end of each tubular member. A single port injection system distributes the air-fuel mixture into the combustion chambers. A plurality of water jackets ports, structured to allow a cooling medium to flow therethrough, extend axially through the outer band of the rotor housing and the first and second stators. A plurality of pick-up coils and magnetic bolts are correspondingly mounted in the stators and rotary discs to trigger the spark plug firing as the rotary discs rotate.

14 Claims, 8 Drawing Sheets

ROTARY DISC ENGINE

BACKGROUND OF THE INVENTION

1. Field of the Invention

The present invention relates in general to the field of rotary engines and, more particularly, to a rotary internal combustion disk engine.

2. Description of the Related Art

Rotary engines were developed to address certain limitations inherent in conventional piston driven reciprocating engines. Specifically, conventional reciprocating engines utilize a plurality of pistons in combination with a multitude of other moving parts, such as connecting rods, crankshafts, camshafts, and intake and exhaust valves. Moreover, the relationship between these moving parts involves constant friction which causes the parts to wear over time and which causes a certain amount of vibration within the engine, thereby stressing all of the parts within and adjacent to the engine.

Over the years several different rotary engine designs have been developed. For instance, U.S. Pat. Nos. 3,282,258, 3,595,014, 4,127,367, and 4,666,379 disclose various rotary engine designs. Although somewhat useful for their intended purposes, none have proven to be entirely satisfactory. Specifically, these prior art engines involve complex configurations which are difficult and, consequently, expensive to manufacture. Additionally, these prior art rotary engines have been found to be inefficient and, consequently, produce insufficient power.

More recent rotary engine designs utilize internal combustion to improve on the insufficient power and inefficiencies of the early designs. For instance, U.S. Pat. Nos. 4,744,736, 5,400,754 and 5,484,272 disclose rotary internal combustion engines which were developed to address the problems associated with the early rotary engine designs. However, these prior art rotary engines still include some of the problems associated with the earlier designs and also have not proven to be entirely satisfactory.

Accordingly, there is still a need in the art for an efficient rotary internal combustion engine which produces sufficient power and which is based on a fairly simple construction which is reasonably inexpensive to manufacture. The present invention is particularly suited to overcome those problems which remain in the art in a manner not previously known.

SUMMARY OF THE INVENTION

The present invention is directed towards a new and improved rotary internal combustion engine comprising a generally cylindrical shaped rotor housing, a pair of cylindrical shaped rotary discs, a pair of substantially flat stators mounted over the open ends of the rotor housing and a fuel injection system. The rotary discs each include an inner concentric member, an outer concentric member and a plurality of spaced apart vanes connecting the inner and outer concentric members and extending axially outward from the inner end of the rotary disc. The rotary discs are structured for mating engagement with one another by inserting the vanes of each rotary disc into the chambers of the other rotary disc formed by the vanes and the inner and outer members, thereby forming an interlocked rotary disc assembly. The resultant rotary disc assembly is structured to rotate within the rotary housing. A plurality of spark plugs protrude through spaced apart mounting holes in one of the stators and into the combustion chambers. A plurality of spaced apart exhaust ports extend through the other stator. A hollow tubular member extends out from a centrally disposed bore in each rotary disc and free wheel embedded therein and through a centrally disposed free wheel in the corresponding stators to prevent backward rotation of the rotary discs. Two additional free wheels embedded in the rotary discs, are connected to a central shaft to produce a continuous rotation in a single direction. A gear wheel, structured to mesh with the gears of a starting motor, is mounted on the end of each tubular member. A single port injection system includes a centrally located throttle body structured to distribute the air-fuel mixture into the combustion chambers via intake runners and intake ports extending radially through the outer band of the rotor housing and corresponding intake ports in the outer concentric member of each rotary disc. The intake ports in the rotor housing and rotary discs are structured and disposed so that, as the rotary discs rotate within the rotor housing, the intake ports in the rotary discs are periodically aligned with the intake ports in the rotor housing, thereby allowing the combustible air-fuel mixture to flow through the intake ports and into the combustion chambers. A plurality of water jackets ports, structured to allow a cooling medium to flow therethrough, extend axially through the outer band of the rotor housing and the first and second stators. A plurality of pick-up coils and magnetic bolts are correspondingly mounted in the stators and rotary discs to trigger the spark plug firing as the rotary discs rotate.

It is an object of the present invention to provide a new and improved rotary internal combustion engine which has all the advantages of the prior art devices and none of the disadvantages.

It is another object of the present invention to provide such an engine which is more efficient than the prior art rotary engines.

It is also an object of the present invention to provide such an engine which produces improved power over the prior art rotary engines.

It is a further object of the present invention to provide such an engine which utilizes a fairly simple construction.

It is yet another object of the present invention to provide such an engine which is reasonably inexpensive to manufacture.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Figure 1:
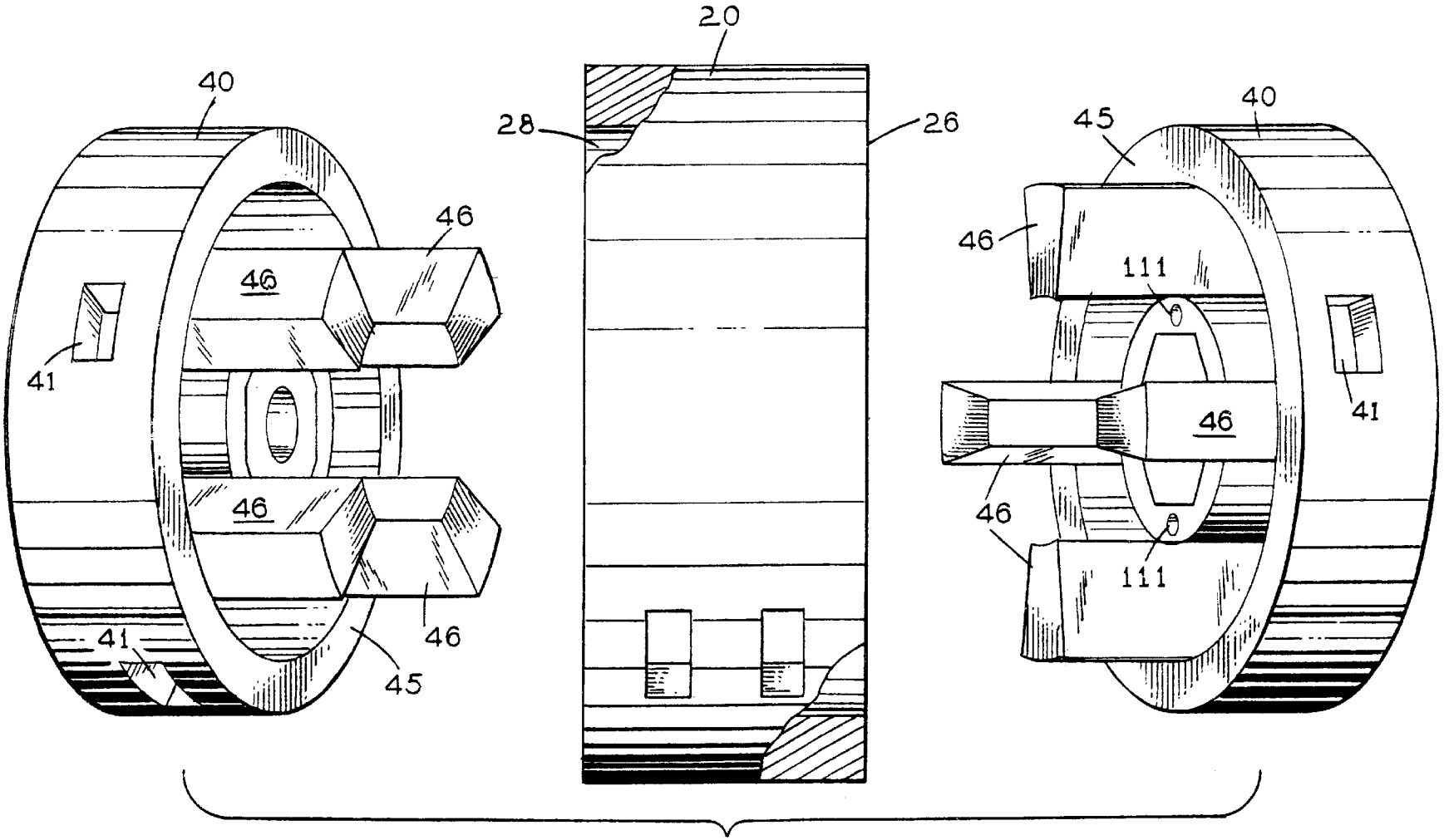
FIG. 1 is an isolated view of the rotor housing and rotary discs.
Figure 2:
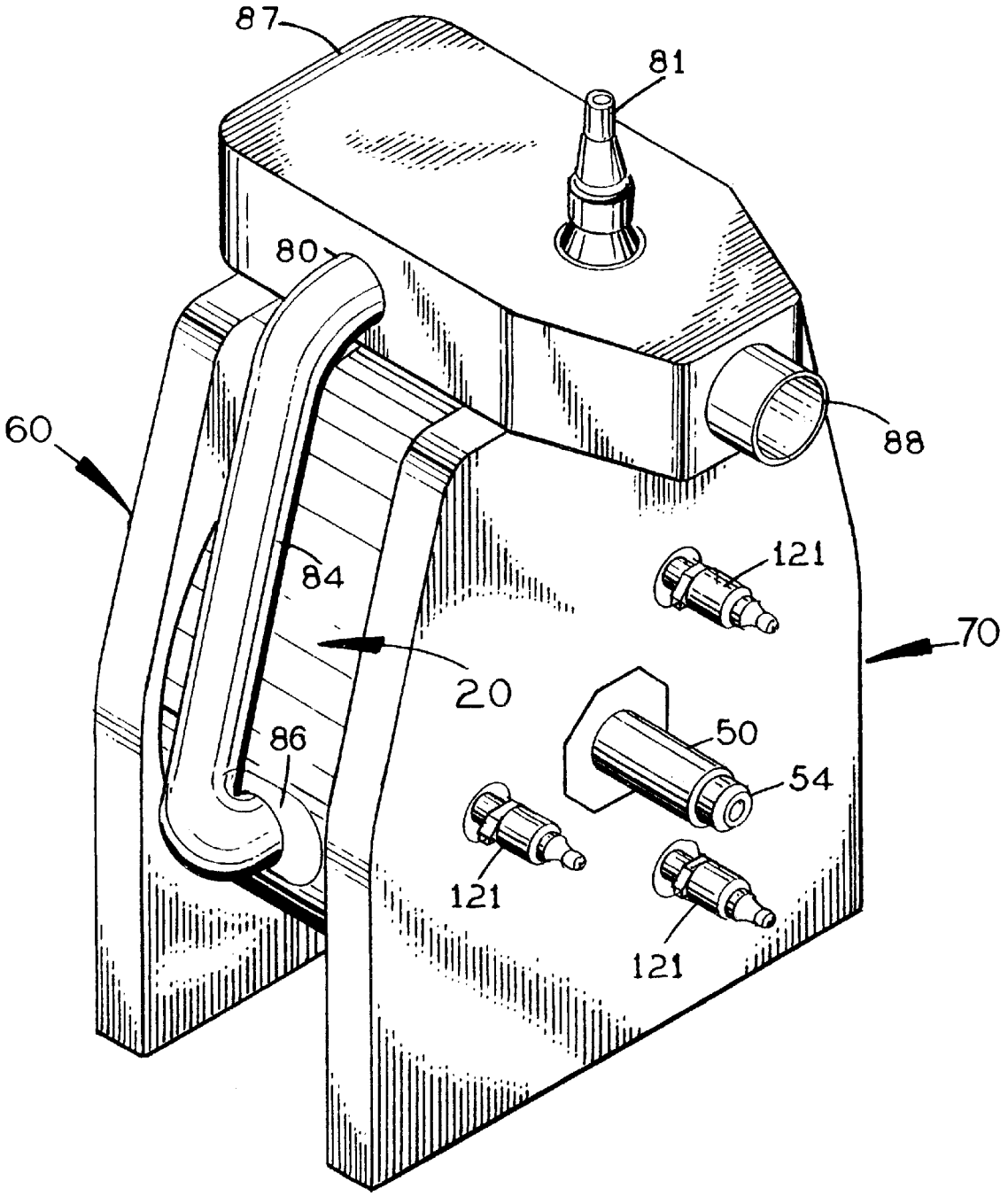
FIG. 2 is a perspective view of the rotary internal combustion engine of the present invention.
Figure 3:
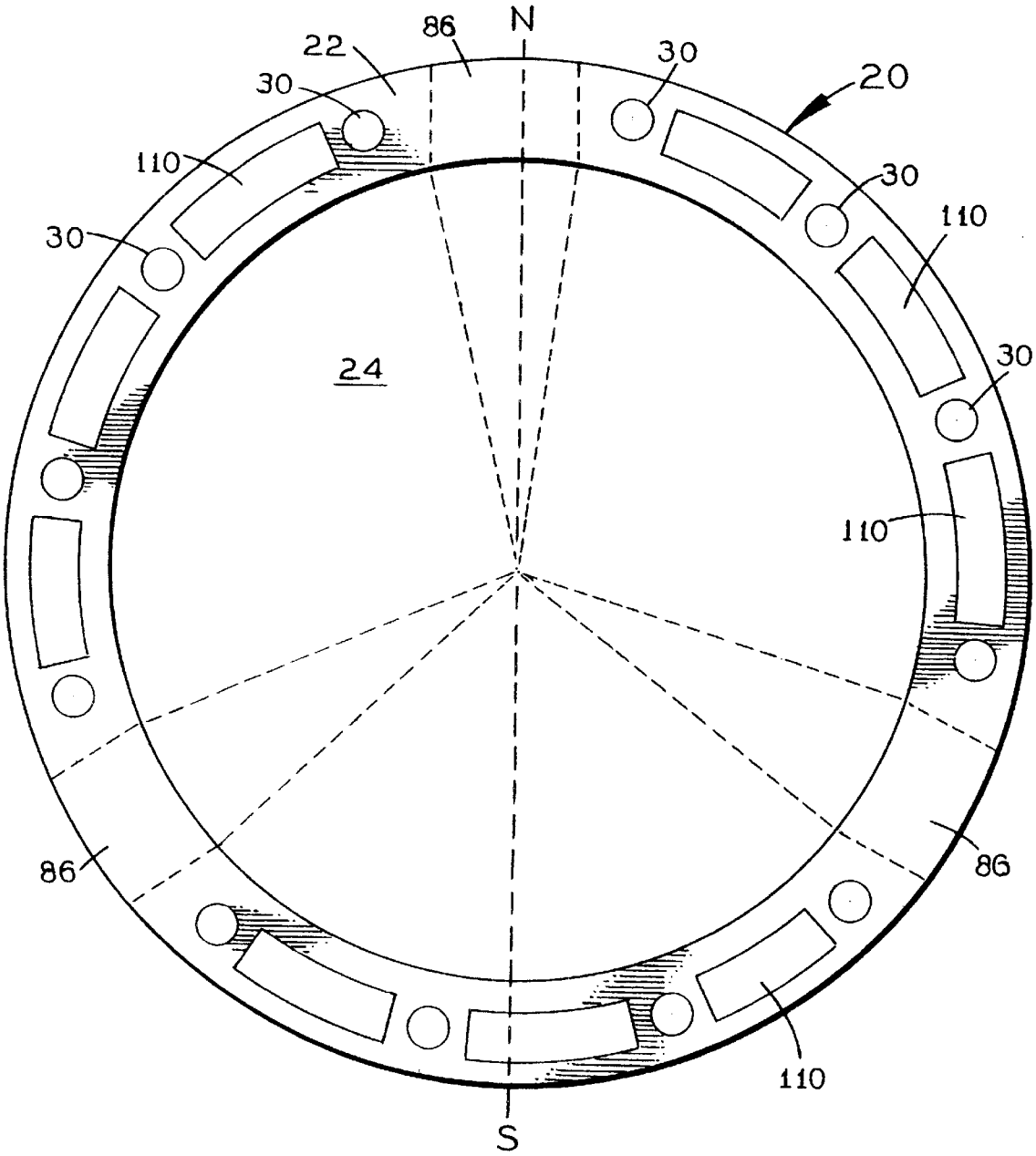
FIG. 3 is a side elevation view of the rotor housing.
Figure 4:
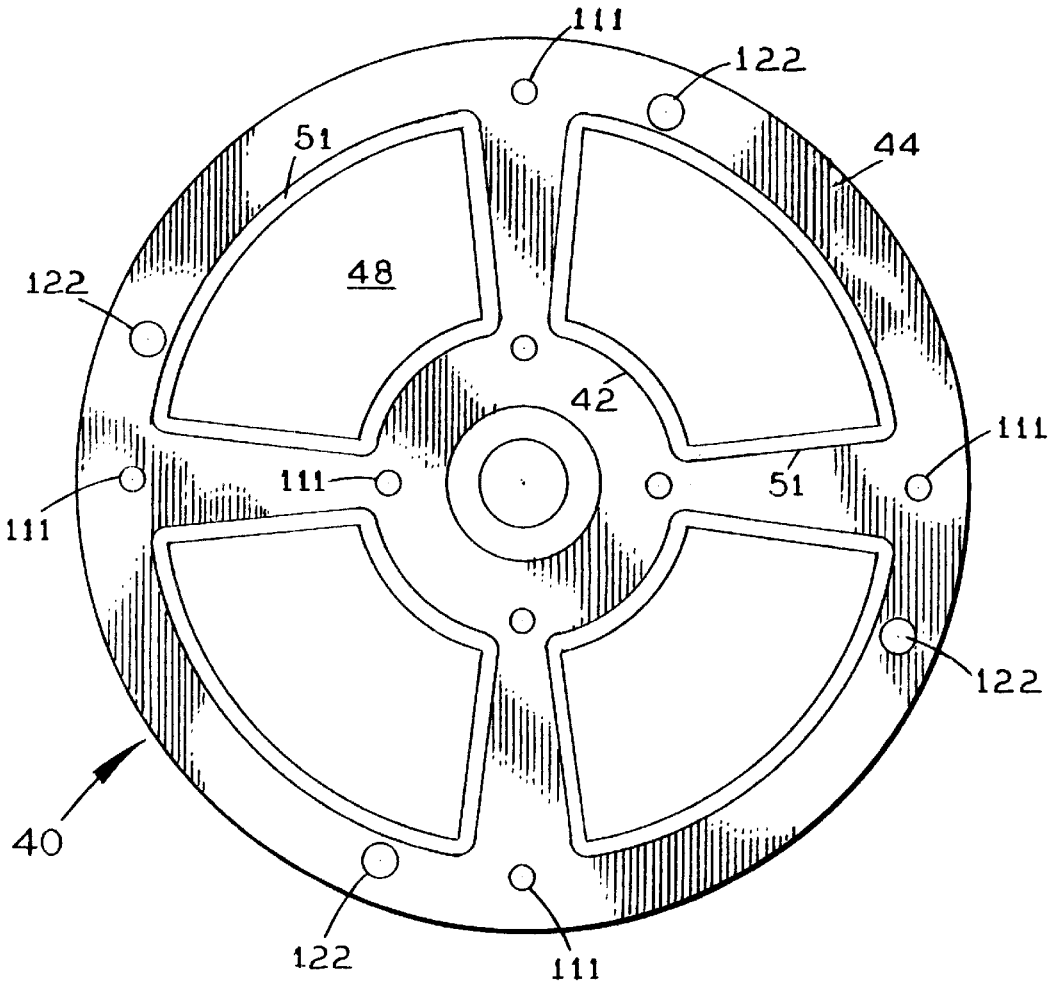
FIG. 4 is a side elevation view of the front rotary disc.
Figure 8A:
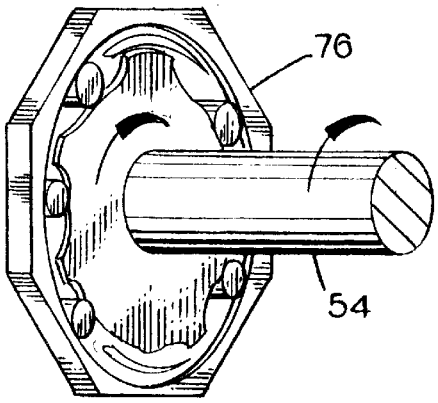
FIGS. 8*a*–8*b* show the freewheeling arrangement.
Figure 8B:
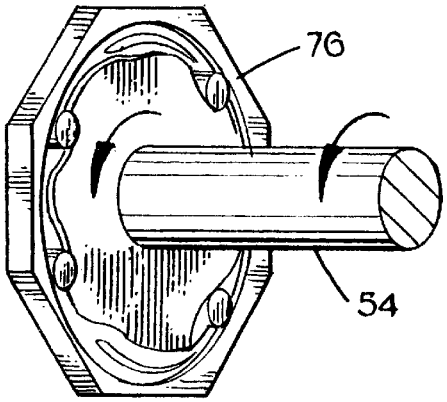
Figure 5:
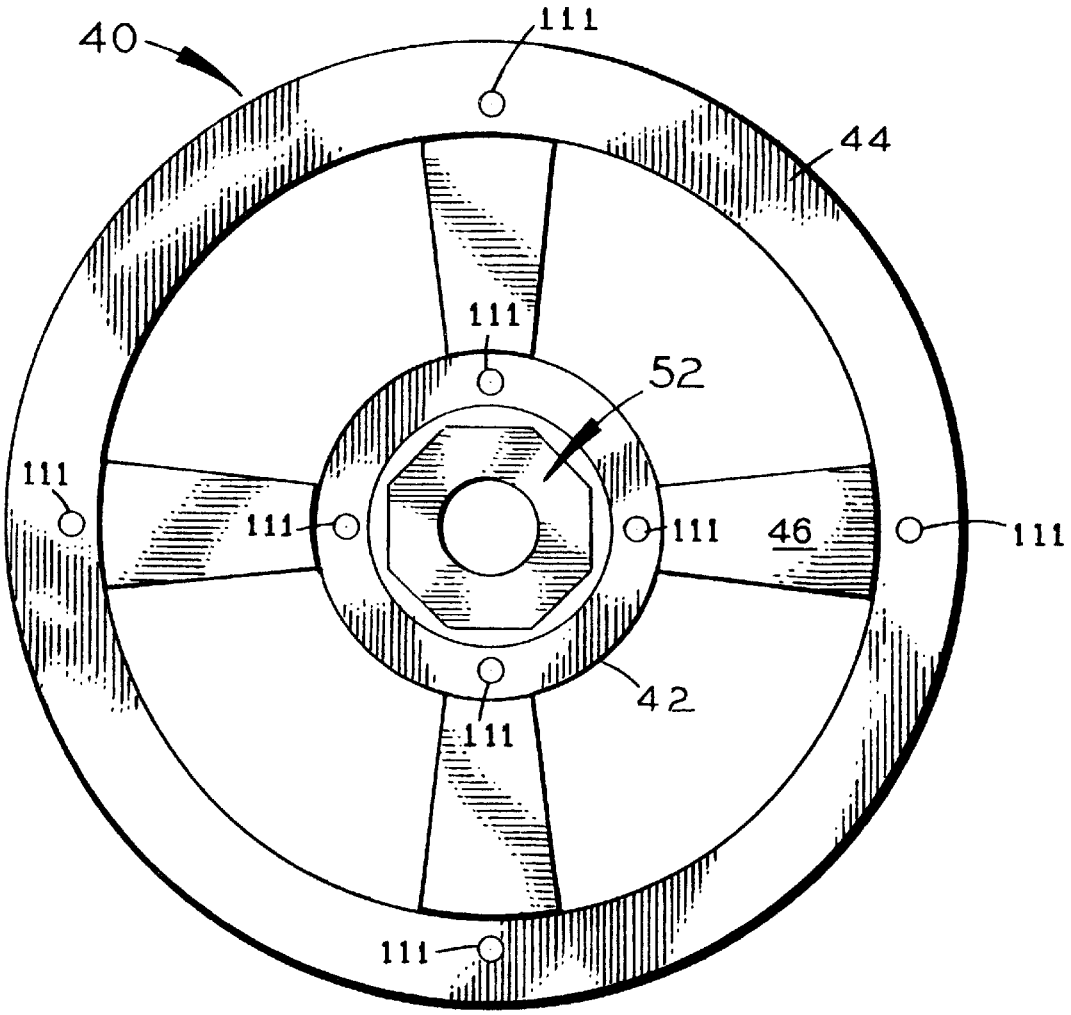
FIG. 5 is a side elevation view of the rear rotary disc.
Figure 6:
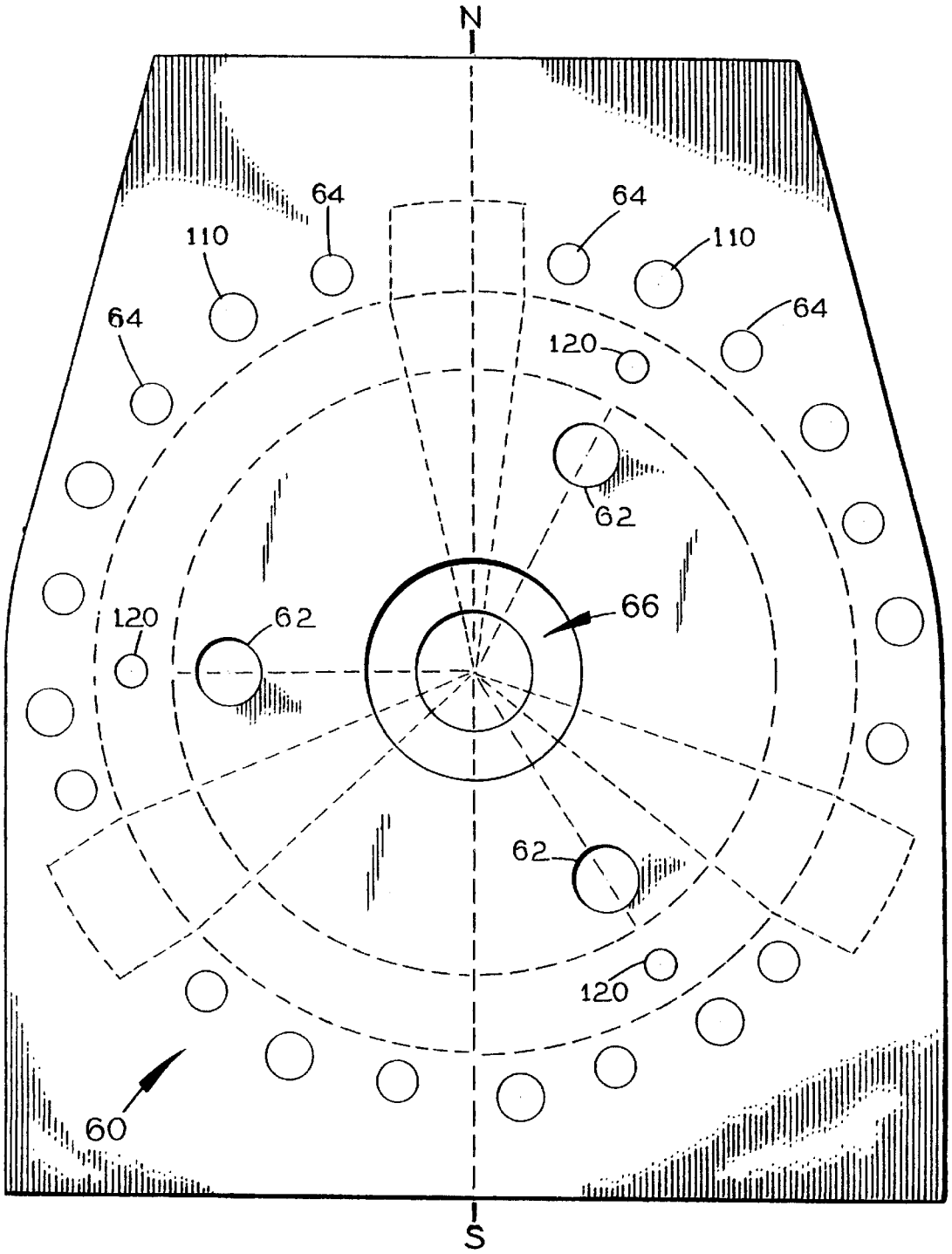
FIG. 6 is a side elevation view of the first stator.
Figure 7:
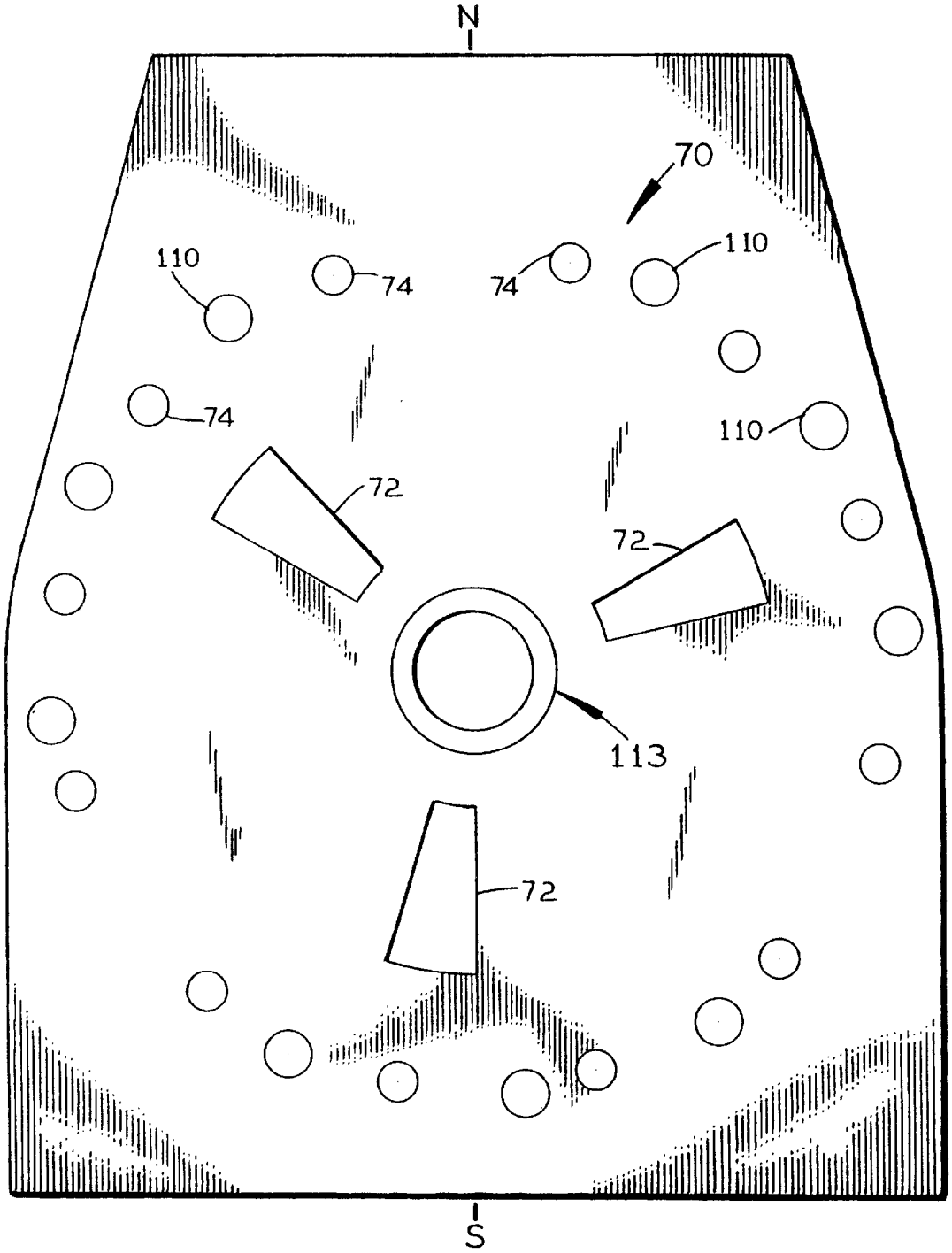
FIG. 7 is a side elevation view of the second stator.
Figure 8:
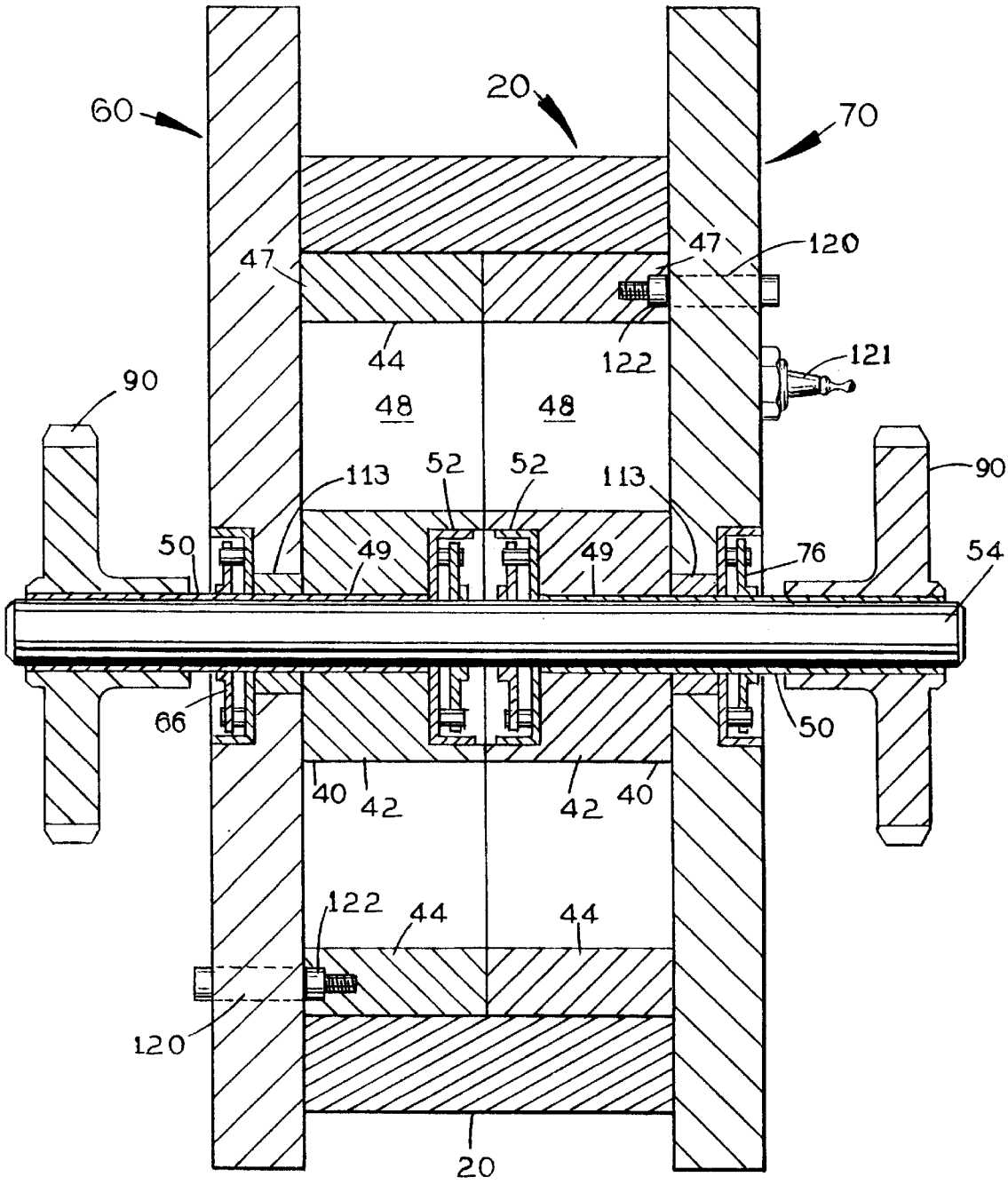
FIG. 8 is cross sectional view of the rotary internal combustion engine.

As shown in FIGS. 1–8, the present invention is directed towards a new and improved rotary internal combustion disc engine 10 comprising a rotor housing 20, a pair of cylindrical shaped rotary discs 40, a pair of substantially flat stators 60, 70 and an injection system 80. The rotor housing 20 is generally cylindrical shaped and includes an outer band 22 surrounding a hollow open chamber 24.

The rotary discs 40 each include an inner concentric member 42, an outer concentric member 44 and a plurality of spaced apart vanes 46 connecting the inner 42 and outer 44 concentric members and extending axially outward from the inner end 45 of the rotary disc 40. A plurality of chambers 48 are defined by the vanes 46 and the inner 42 and outer 44 members. The rotary discs 40 are structured for mating engagement with one another by inserting the vanes 46 of each rotary disc 40 into the chambers 48 of the other rotary disc 40, thereby forming an interlocked rotary disc assembly. The resultant rotary disc assembly is structured to rotate within the rotary housing 20. In the present embodiment, each rotary disc 40 includes four vanes 46, thereby forming eight chambers 48 upon combining the rotary discs 40 into the rotary disc assembly. Oil seals 51 are positioned around the chambers 48 between the rotary disks 40 and stators 60, 70 to prevent oil from getting into the combustion chambers 48.

The first stator 60 is mounted over the first open end 26 of the rotor housing 20 and includes a plurality of spaced apart spark plug mounting holes 62, each structured to removably receive a spark plug therein. In the present embodiment, three spark plugs are provided. A plurality of spaced apart mounting holes 64 are disposed on the first stator 60 to align with corresponding internally threaded mounting holes 30 in the outer band 22 of the rotor housing 20, adjacent the first open end 26. The mounting holes 64, 30 are structured to secure the first stator 60 to the rotor housing 20 with externally threaded screws or bolts.

The second stator 70 is mounted over the second open end 28 of the rotor housing 20 and includes a plurality of spaced apart exhaust ports 72 extending therethrough. The exhaust ports 72 are disposed so that exhaust gas may escape the chambers 48 in the rotary discs 40. In the present embodiment, three exhaust ports 72 are provided. A plurality of spaced apart mounting holes 74 are disposed on the second stator 70 to align with corresponding internally threaded mounting holes 30 in the outer band 22 of the rotor housing 20, adjacent the second open end 28. The mounting holes 74, 30 are structured to secure the second stator 70 to the rotor housing 20 with externally threaded screws or bolts.

Each rotary disc 40 also includes a free wheel 52 embedded within a central, axially disposed bore 49 in the inner concentric member 42. A hollow tubular member 50 extends out from the bore 49 and free wheel 52 through the outer end 47 of each rotary disc 40 and through a centrally disposed free wheel 66, 76 in the corresponding first 60 and second 70 stators. The free wheels 66, 76 in the first and second stators 60, 70 are structured to prevent backward rotation of the rotary discs 40. The free wheels 52 are connected to a central shaft 54 which extends through the tubular member 50 to produce a continuous rotation in a single direction.

A gear wheel 90 is mounted on the end of each tubular member 50. The gear wheels 90 are structured and disposed to mesh with the gears of a starting motor.

The fuel injection system 80 is a single point injector 81 mounted in a centrally located throttle body 82 to distribute the air-fuel mixture into the combustion chambers 48 via the plenum 87 and the intake runners 84, intake ports 86 extending radially through the outer band 22 of the rotor housing 20 and corresponding intake ports 41 in the outer concentric member 44 of each rotary disc 40. The intake ports 86, 41 in the rotor housing 20 and rotary discs 40 are structured and disposed so that, as the rotary discs 40 rotate within the rotor housing 20, the intake ports 41 in the rotary discs are periodically aligned with the intake ports 86 in the rotor housing 20, thereby allowing the combustible air-fuel mixture to flow through the intake ports 86, 41 and into the combustion chambers 48. The air enters the system 80 through an air inlet 88 connected to the system 80. Although a single point system is preferred, it should be appreciated that a multiport injection system may, alternatively, be utilized to improve fuel distribution.

A plurality of water jackets ports 110 extend axially through the outer band 22 of the rotor housing 20 and the first 60 and second 70 stators. The water jacket ports 110 are structured to allow a cooling medium to flow therethrough. Oil inlet passages 111 allow oil to flow in between the discs and the stator. There is a bushing 113 in each stator to avoid leakage of oil.

A plurality of pick-up coils 120 extend through the first 60 and second stators 70 and are structured for periodic alignment with magnetic bolts 122 mounted within the outer end 47 of the outer concentric member 44 of each rotary disc 40 as the rotary discs 40 rotate. Upon alignment of the magnetic bolts 122 and pick-up coils 120, each pick-up coil 120 generates a small alternating current which signals an electronic control unit to trigger the corresponding spark plug to fire. In the present embodiment, three pick-up coils 120 and spark plugs 121 are utilized.

In operation, the rotary internal combustion engine 10 of the present invention comprises eight working chambers, four in the expanding stage and four in the contracting stage. A typical cycle is initiated by the ignition stroke in chamber 1, which:

1. completes the exhaust stroke in chamber 2;
2. brings in the air-fuel mixture into chamber 3 through the intake ports 86, 41;
3. partially compresses burned gas in chamber 4;
4. suctions some of the air-fuel mixture into chamber 5;
5. compresses the air-fuel mixture in chamber 6;
6. scavenges some burned gas from an exhaust port into chamber 7; and
7. returns some of the air-fuel mixture from chamber 8 to an intake runner 84.

The cycle is then repeated when the compressed gas in chamber 6 is ignited by the corresponding spark plug.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A rotary internal combustion disc engine comprising:

a cylindrical shaped rotor housing having a first open end and an opposite second open end;

a pair of cylindrical shaped rotary discs, each of said rotary discs having an inner concentric member, an outer concentric member with at least one port extending radially therethrough and a plurality of spaced apart vanes connecting said outer and inner members and extending axially outward from said rotary disc, said outer member, said inner member and said vanes defining a plurality of chambers;

said rotary discs being structured for mating engagement with one another by inserting said vanes of a first one of said rotary discs into said chambers of a second one of said rotary discs and said vanes of said second one of said rotary discs into said chambers of said first one of said discs, thereby forming an interlocked rotary disc assembly, said rotary disc assembly being structured to rotate within said rotary housing;

a first substantially flat stator mounted over said first open end of said rotor housing;

a second substantially flat stator mounted over said second open end of said rotor housing and having a plurality of exhaust ports;

each of said rotary discs further including an axially disposed tubular member extending out from said inner member, said tubular member of said first one of said rotary discs being structured and disposed to extend through said first stator and said tubular member of said second one of said rotary discs being structured and disposed to extend through said second stator;

a pair of gear wheels, each of said gear wheels being mounted on an end of one of said tubular members and being meshed with a starting motor gear;

a centrally disposed shaft connected to said rotary discs and extending through said tubular members, said shaft and tubular members being structured to ensure rotation of said rotary discs in a single direction;

means for injecting a combustible material into said plurality of chambers; and means for igniting said combustible material in select ones of said plurality of chambers.

2. The rotary internal combustion disc engine as recited in claim 1 wherein said means for injecting a combustible material into said plurality of chambers comprises an injection system.

3. The rotary internal combustion disc engine as recited in claim 2 wherein said fuel injection system comprises a supply conduit or plenum and three intake runners, each of said runners having a first end coupled to an intake port extending through said rotor housing and an opposite second end coupled to said supply conduit, or plenum, said supply conduit being structured to allow said combustible material to flow therethrough, said intake ports in said rotor housing and said at least one port in said outer concentric member of said rotary discs being structured and disposed for periodic alignment with one another upon rotation of said rotary discs within said rotor housing, thereby allowing said combustible material to flow through said intake conduit, said intake ports and said at least one port and into said plurality of chambers.

4. The rotary internal combustion disc engine as recited in claim 1 wherein said means for igniting said combustible material in select ones of said plurality of chambers comprises three spark plugs extending through said first stator and into said rotor housing and means for actuating said three spark plugs.

5. The rotary internal combustion disc engine as recited in claim 4 wherein said means for actuating said three spark plugs comprises a plurality of magnetic bolts mounted in said outer concentric members of said rotary discs and three pick-up coils mounted in each of said first and second stators, said magnetic bolts and pick-up coils being structured and disposed to engage one another upon rotation of said rotary discs, thereby causing said pick-up coil to generate an electronic signal which triggers said at least one spark plug.

6. The rotary internal combustion disc engine as recited in claim 1 further comprising means for cooling the engine.

7. The rotary internal combustion disc engine as recited in claim 6 wherein said means for cooling the engine comprises a plurality of water jackets extending axially through an outer band of said rotor housing and said first and second stators, said water jackets being structured to allow a cooling medium to flow therethrough.

8. A rotary internal combustion disc engine comprising:

a cylindrical shaped rotor housing having a first open end and an opposite second open end;

a pair of cylindrical shaped rotary discs, each of said rotary discs having an inner concentric member, an outer concentric member with at least one port extending radially therethrough and a plurality of spaced apart vanes connecting said outer and inner members and extending axially outward from said rotary disc, said outer member, said inner member and said vanes defining a plurality of chambers;

said rotary discs being structured for mating engagement with one another by inserting said vanes of a first one of said rotary discs into said chambers of a second one of said rotary discs and said vanes of said second one of said rotary discs into said chambers of said first one of said discs, thereby forming an interlocked rotary disc assembly, said rotary disc assembly being structured to rotate within said rotary housing;

a first substantially flat stator mounted over said first open end of said rotor housing;

a second substantially flat stator mounted over said second open end of said rotor housing and having a plurality of exhaust ports;

each of said rotary discs further including an axially disposed tubular member extending out from said inner member, said tubular member of said first one of said rotary discs being structured and disposed to extend through said first stator and said tubular member of said second one of said rotary discs being structured and disposed to extend through said second stator;

a pair of gear wheels, each of said gear wheels being mounted on an end of one of said tubular members and being meshed with a starting motor gear;

a centrally disposed shaft connected to said rotary discs and extending through said tubular members, said shaft and tubular members being structured to ensure rotation of said rotary discs in a single direction;

means for injecting a combustible material into said plurality of chambers;

three spark plugs extending through said first stator and into said rotor housing; and means for actuating said three spark plugs comprising four magnetic bolts mounted in said outer concentric members of said rotary discs and three pick-up coils mounted in each of said first and second stators, said magnetic bolts and pick-up coils being structured and disposed to engage one another upon rotation of said rotary discs, thereby causing said pick-up coils to generate an electronic signal which triggers said three spark plugs.

9. The rotary internal combustion disc engine as recited in claim 8 wherein said means for injecting a combustible material into said plurality of chambers comprises an injection system.

10. The rotary internal combustion disc engine as recited in claim 8 further comprising means for cooling the engine.

11. The rotary internal combustion disc engine as recited in claim 10 wherein said means for cooling the engine comprises a plurality of water jackets extending axially through an outer band of said rotor housing and said first and second stators, said water jackets being structured to allow a cooling medium to flow therethrough.

12. A rotary internal combustion disc engine comprising:

a cylindrical shaped rotor housing having an outer band, a first open end and an opposite second open end;

a pair of cylindrical shaped rotary discs, each of said rotary discs having an inner concentric member, an outer concentric member with at least one port extending radially therethrough and a plurality of spaced apart vanes connecting said outer and inner members and extending axially outward from said rotary disc, said outer member, said inner member and said vanes defining a plurality of chambers;

said rotary discs being structured for mating engagement with one another by inserting said vanes of a first one of said rotary discs into said chambers of a second one of said rotary discs and said vanes of said second one of said rotary discs into said chambers of said first one of said discs, thereby forming an interlocked rotary disc assembly, said rotary disc assembly being structured to rotate within said rotary housing;

a first substantially flat stator mounted over said first open end of said rotor housing;

a second substantially flat stator mounted over said second open end of said rotor housing and having a plurality of exhaust ports extending therethrough;

means for cooling the engine comprising a plurality of water jackets extending axially through said outer band and said first and second stators, said water jackets being structured to allow a cooling medium to flow therethrough;

each of said rotary discs further including an axially disposed tubular member extending out from said inner member, said tubular member of said first one of said rotary discs being structured and disposed to extend through said first stator and said tubular member of said second one of said rotary discs being structured and disposed to extend through said second stator;

a pair of gear wheels, each of said gear wheels being mounted on an end of one of said tubular members and being meshed with a starting motor gear;

a centrally disposed shaft connected to said rotary discs and extending through said tubular members, said shaft and tubular members being structured to ensure rotation of said rotary discs in a single direction;

means for injecting a combustible material into said plurality of chambers;

three spark plugs extending through said first stator and into said rotor housing; and means for actuating said three park plugs comprising a plurality of magnetic bolts mounted in said outer concentric members of said rotary discs and three pick-up coils mounted in each of said first and second stators, said magnetic bolts and pick-up coils being structured and disposed to engage one another upon rotation of said rotary discs, thereby causing said pick-up coil to generate an electronic signal which triggers said at least one spark plug.

13. The rotary internal combustion disc engine as recited in claim 12 wherein said means for injecting a combustible material into said plurality of chambers comprises an injection system.

14. The rotary internal combustion disc engine as recited in claim 13 wherein said fuel injection system comprises a supply conduit or plenum and three intake runners, each of said runners having a first end coupled to an intake port extending through said rotor housing and an opposite second end coupled to said supply conduit or plenum, said supply conduit being structured to allow said combustible material to flow therethrough, said intake ports in said rotor housing and said at least one port in said outer concentric member of said rotary discs being structured and disposed for periodic alignment with one another upon rotation of said rotary discs within said rotor housing, thereby allowing said combustible material to flow through said intake conduit, said intake ports and said at least one port and into said plurality of chambers.

* * * * *